US006471421B2

(12) United States Patent
Kitamura

(10) Patent No.: US 6,471,421 B2
(45) Date of Patent: Oct. 29, 2002

(54) DEVELOPING UNIT AND DEVELOPING METHOD

(75) Inventor: Tetsuya Kitamura, Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/849,303

(22) Filed: May 7, 2001

(65) Prior Publication Data

US 2001/0043813 A1 Nov. 22, 2001

(30) Foreign Application Priority Data

May 10, 2000 (JP) ..... 2000-137073

(51) Int. Cl.[7] ..... G03D 5/00

(52) U.S. Cl. ..... 396/604; 396/611; 396/627; 427/240; 118/52

(58) Field of Search ..... 396/604, 611, 396/627; 118/52, 319–321; 427/240

(56) References Cited

U.S. PATENT DOCUMENTS 5,571,560 A * 11/1996 Lin ..... 118/305
5,625,433 A 4/1997 Inada et al. ..... 396/604
5,845,170 A 12/1998 Ogata ..... 396/611
5,854,953 A 12/1998 Semba ..... 396/611
5,935,331 A * 8/1999 Naka et al. ..... 118/319
6,113,697 A * 9/2000 Kim ..... 118/321
6,238,107 B1 * 5/2001 Inada ..... 118/52

* cited by examiner

*Primary Examiner*—D. Rutledge
(74) *Attorney, Agent, or Firm*—Oblon, Spivak, McClelland, Maier & Neustadt, P.C.

(57) ABSTRACT

The present invention is a developing method for performing developing treatment for a substrate, having the steps of moving a developing solution supply nozzle from one end of the substrate to the other end along a horizontal direction and a predetermined direction above the rotating substrate, and supplying a developing solution to the substrate from the aforementioned developing solution supply nozzle during the movement, and when the developing solution supply nozzle moves from one end of the substrate to the other end, a rotational speed of the substrate is changed. According to the present invention, the amount of the developing solution supplied to the center area of the substrate is decreased, and thereby evenness of the developing solution within the substrate surface can be improved.

7 Claims, 13 Drawing Sheets

DEVELOPING UNIT AND DEVELOPING METHOD

BACKGROUND OF THE INVENTION

1. Field of the Invention

The present invention relates to a developing unit and a developing method for a substrate.

2. Description of the Related Art

In a photolithography process in semiconductor device fabrication processes, for example, resist coating treatment in which a resist solution is applied on a top surface of a wafer and a resist film is formed thereon, exposure processing in which the wafer is exposed in a pattern, developing treatment in which development is performed for the wafer after being exposed, and the like are performed in order, and thereby a predetermined circuit pattern is formed on the wafer.

The aforementioned developing processing is normally performed in a developing unit. The developing unit has a spin chuck for holding an undersurface of the wafer by suction and rotating the wafer, and a long thin developing solution supply nozzle moving in a predetermined direction above the wafer, with a plurality of supply ports of the same diameter being formed along a longitudinal direction thereof. The wafer is kept rotated at a predetermined speed previously, and the developing solution supply nozzle is moved from one end above the wafer to a center portion while discharging a developing solution. Subsequently, in a state in which the developing solution supply nozzle is stopped above the center portion of the wafer, it further continues to supply the developing solution, thereby performing solution heaping of the developing solution on an entire top surface of the wafer.

In order to supply the developing solution onto the rotating wafer evenly within the wafer surface, it is necessary to decrease a supply amount to the center portion having a smaller supply area than a peripheral portion of the wafer. In a conventional developing unit, however, a plurality of supply ports are designed to have the same diameter, and therefore a larger quantity of developing solution is supplied to the center portion of the wafer compared with the peripheral portion of the wafer.

Meanwhile, since it is sufficient if the developing. solution can be supplied to the entire surface of the wafer, the developing solution supply nozzle is conventionally moved to the center area above the wafer and is stopped there to discharge the developing solution to the rotating wafer. However, if the developing solution supply nozzle is stopped above the wafer and continues to discharge the developing solution as it is, which causes more developing solution to be supplied to the wafer center portion compared with the wafer peripheral portion.

SUMMARY OF THE INVENTION

The present invention is made in view of the above points, and its object is to balance the amount of developing solution supplied to a substrate within a substrate surface when developing treatment is performed for a substrate such as a wafer.

In order to attain the above object, a developing unit of the present invention has a rotating device for rotating the substrate while holding the substrate, and a developing solution supply nozzle movable above the substrate in a horizontal direction and in a predetermined direction including a center of the substrate, for supplying a developing solution to the substrate, and the developing solution supply nozzle has a plurality of supply ports provided to be aligned in a direction forming a predetermined angle with the predetermined direction, and the supply ports include supply ports of which diameter sizes are different.

Further, according to another aspect of the present invention, a developing method of the present invention has the steps of moving a developing solution supply nozzle from one end to the other end of the substrate along a horizontal direction and a predetermined direction above the rotating substrate, and supplying a developing solution to the substrate from the developing solution supply nozzle during the aforementioned movement, and when the developing solution supply nozzle moves from one end of the substrate to the other end, a rotational speed of the substrate is changed.

By using the developing solution supply nozzle having the supply ports of different diameters, the flow rate of the developing solution discharged form each supply port is regulated, and thus the amount of the developing solution finally supplied onto the substrate can be made even within the substrate surface. In concrete, the diameters of the supply ports corresponding to the portions with a comparatively large supply amount of the developing solution are made smaller, while the diameters of the support ports corresponding to the portions with less supply amount are made larger, whereby the amount of the developing solution supplied to the substrate surface is adjusted to be even. The sizes of the supply ports of which diameters are changed, position, the number thereof and the like differ depending on developing treatment units, thus it is suitable to adopt the support ports individually corresponding to each apparatus. Further, the predetermined angle of about 0° to 30° is suitable.

According to the method of the present invention, the developing solution supply nozzle moves from one end of the substrate to the other end, thereby reducing the necessity for supplying the developing solution onto the substrate with the developing solution supply nozzle being stopped for a long period of time as conventionally, thus making it possible to supply the developing solution while it moves from the center to the other end. Accordingly, the time, which is taken to supply the developing solution with the developing solution supply nozzle being stopped above the center of the substrate, is shortened, thus preventing a relatively large amount of developing solution from being supplied to the center portion of the substrate having a small supply area. Further, if the rotational speed of the substrate is changed, for example, to a lower speed, more developing solution is supplied to the same portion on the substrate, and to the contrary, if it is changed to a higher speed, a smaller amount of the developing solution is supplied to the same portion, thus making it possible to change and control the supply amount of the developing solution. Accordingly, the amount of the developing solution finally supplied on the substrate can be made even within the surface of the substrate.

DETAILED DESCRIPTION OF THE PREFERRED EMBODIMENTS

Figure 1:
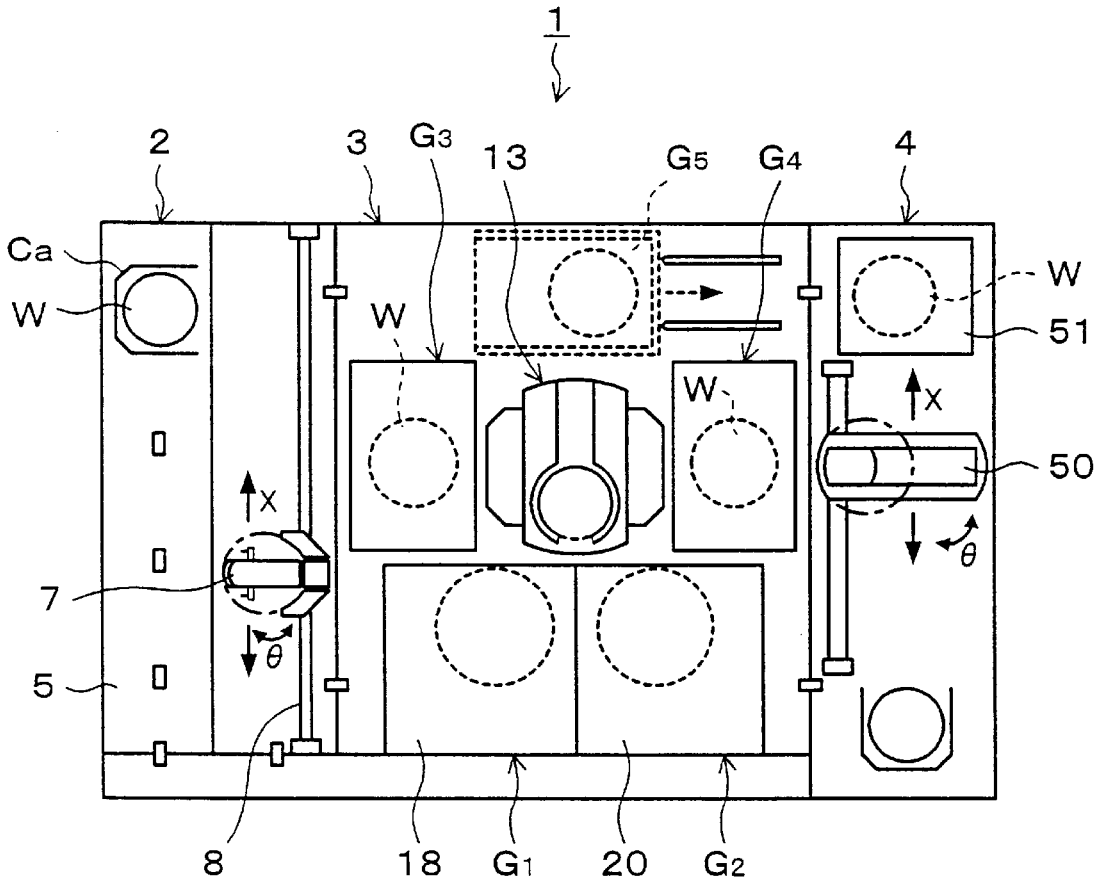
FIG. 1 is a plane view showing an outline of a configuration of a coating and developing system in which a developing unit according to the present embodiment is incorporated.
Figure 2:
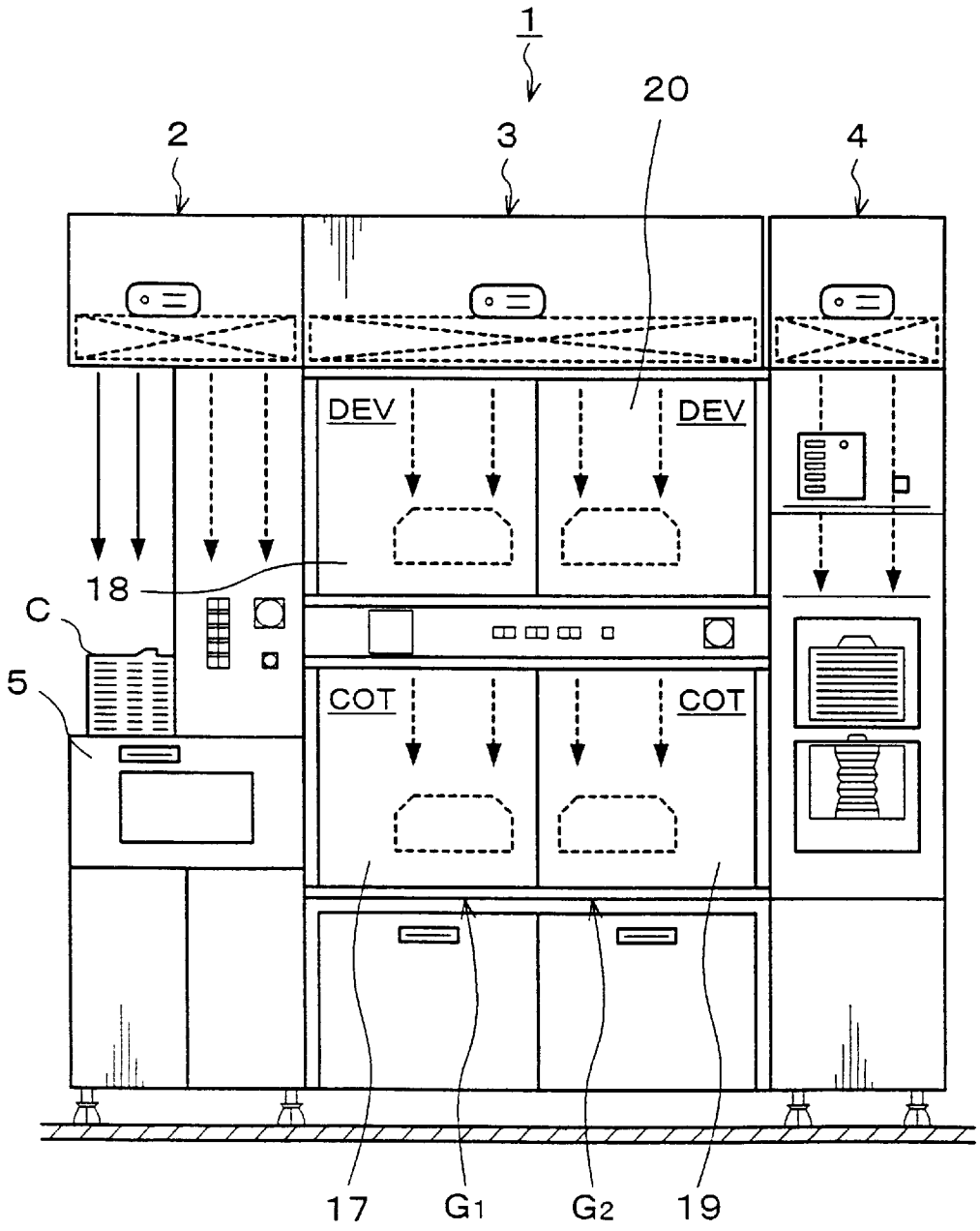
FIG. 2 is a front view of the coating and developing system in FIG.1.
Figure 3:
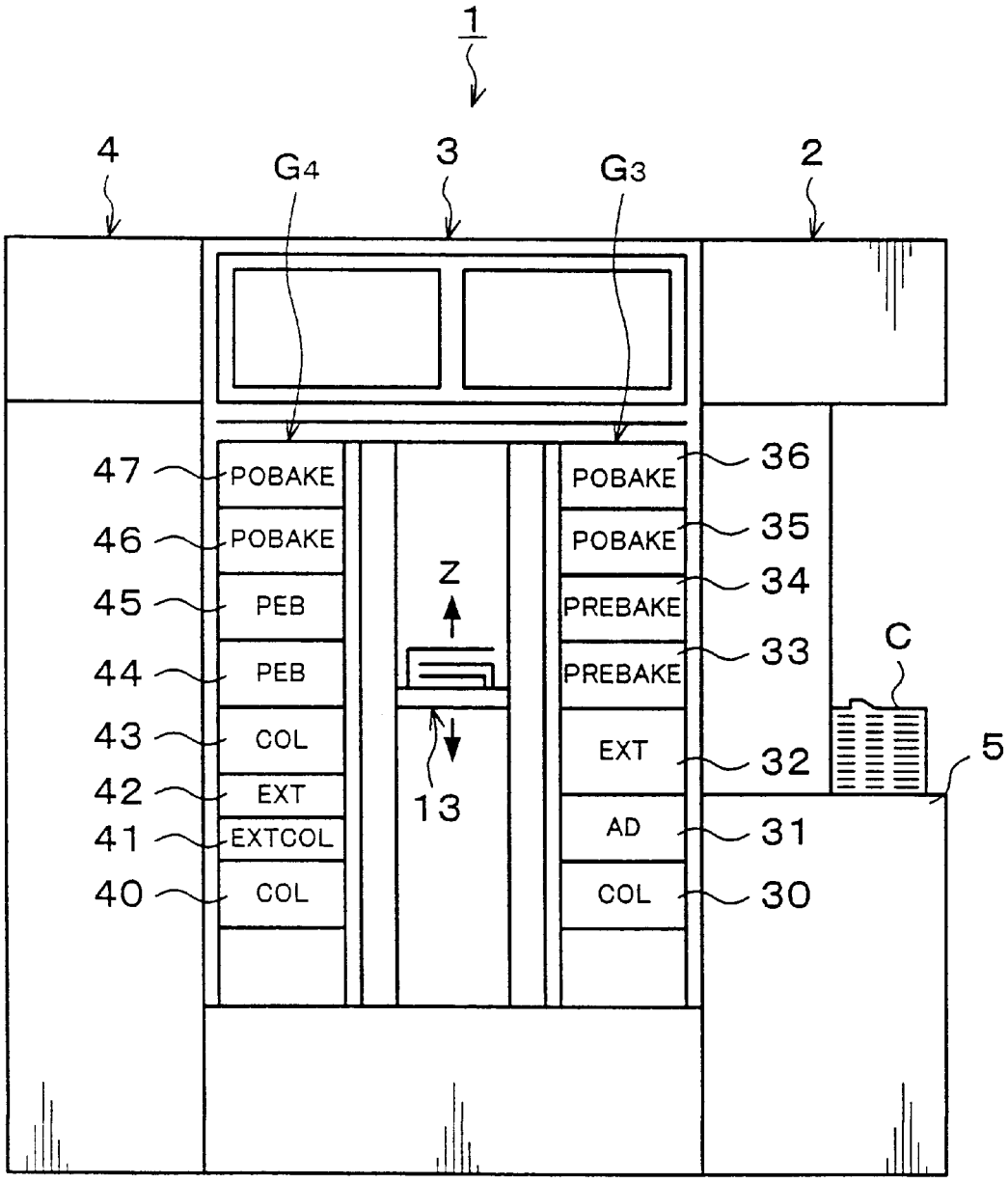
FIG. 3 is a rear view of the coating and developing system in FIG. 1.

A preferred embodiment of the present invention will be explained below. FIG. 1 is a plane view of a coating and developing system 1 having a developing unit according to the present embodiment, FIG. 2 is a front view of the coating and developing system 1, and FIG. 3 is a rear view of the coating and developing system 1.

As shown in FIG. 1, the coating and developing system 1 has a structure in which a cassette station 2 for carrying, for example, 25 wafers W from/to the outside to/from the coating and developing system 1 in the unit of cassette and for carrying the wafers W into/from a cassette C, a processing station 3 in which various kinds of multi-tiered processing and treatment units for performing predetermined processing and treatment for the wafers one by one in the coating and developing process are disposed, and an interface section 4 for receiving and delivering the wafer W from/to an aligner not shown provided adjacently to the processing station 3, are integrally connected.

In the cassette station 2, a plurality of cassettes C are mountable at predetermined positions on a cassette mounting table 5 serving as a mounting section in a line in an X-direction (the up-and-down direction in FIG. 1). Further, a wafer carrier 7, which is transferable in the direction of alignment of the cassettes (the X-direction) and in the direction of alignment of the wafers W housed in the cassette C (a Z-direction; a vertical direction), is provided to be movable along a carrier path 8 and is selectively accessible to the respective cassettes C.

The wafer carrier 7 has an alignment function for aligning the wafer W. The wafer carrier 7 is structured so as to be also accessible to an extension unit 32 included in a third processing unit group G3 on the side of the processing station 3 as will be described later.

In the processing station 3, a main transfer device 13 is provided in a center part thereof, and various kinds of processing units are multi-tiered around the periphery of the main transfer device 13 to compose processing unit groups. In the coating and developing system 1, there disposed are four processing unit groups G1, G2, G3 and G4, and the first and the second processing unit groups G1 and G2 are disposed on the front side of the coating and developing system 1, the third processing unit group G3 is disposed adjacently to the cassette station 2, and the fourth processing unit group G4 is disposed adjacently to the interface section 4. Further, as an option, a fifth processing unit group G5 depicted by the broken line can be additionally arranged on the rear side thereof. The aforementioned main carrier unit 13 can carry the wafer W into/from various kinds of processing units described later disposed in these processing unit groups G1, G2, G3, G4 and G5.

In the first processing unit group G1, a resist coating unit 17 for applying a resist solution to the wafer W and a developing unit 18 for performing developing treatment for the wafer W after exposure processing are two-tiered in the order from the bottom, for example, as shown in FIG. 2. As for the second processing unit group G2, a resist coating unit 19 and a developing unit 20 are similarly two-tiered in the order from the bottom.

In the third processing unit group G3, a cooling unit 30 for cooling the wafer W, an adhesion unit 31 for increasing the adhesion between a resist solution and the wafer W, the extension unit 32 for receiving and delivering the wafer W, prebaking units 33 and 34 for drying a solvent in the resist solution, postbaking units 35 and 36 for performing heating treatment after developing treatment, and so on are, for example, seven-tiered in the order from the bottom.

In the fourth processing unit group G4, for example, a cooling unit 40, an extension and cooling unit 41 for naturally cooling the mounted wafer W, an extension unit 42, a cooling unit 43, post exposure baking units 44 and 45 for performing heat treatment after exposure processing, postbaking units 46 and 47, and the like are, for example, eight-tiered in the order from the bottom.

A wafer carrier 50 is provided at a center portion of the interface section 4. The wafer carrier 50 is structured so as to be movable in the X-direction (the up-and-down direction in FIG. 1) and the Z-direction (the vertical direction), and to be rotatable in a θ-direction (a rotational direction around an axis Z), so that it can access the extension and cooling unit 41, the extension unit 42, and a peripheral aligner 51 included in the fourth processing unit group G4, and an aligner not shown, and can transfer the wafer W to each of them.

Figure 4:
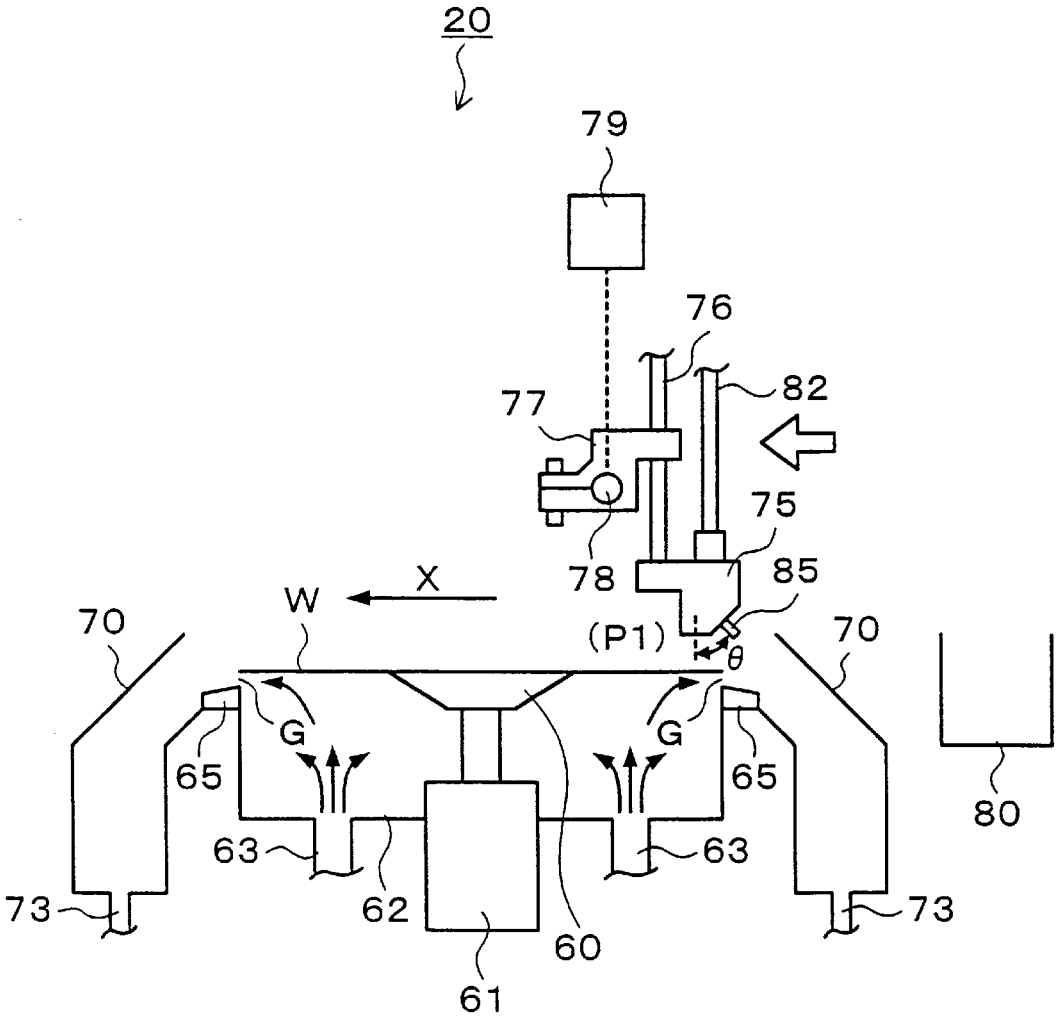
FIG. 4 is an explanatory view showing an outline of a configuration of the developing unit according to the present embodiment.
Figure 5:
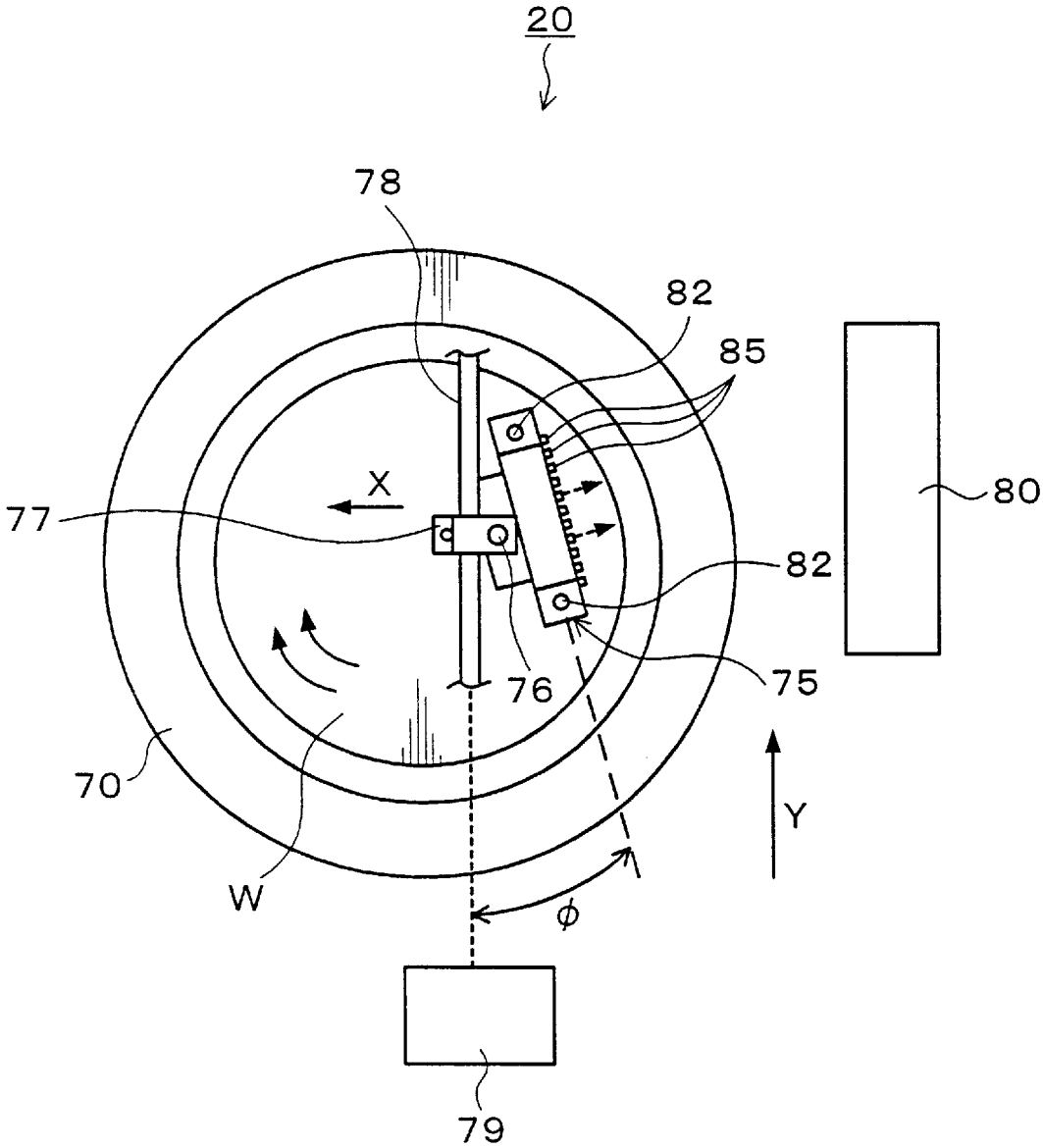
FIG. 5 is an explanatory view in plane showing a configuration of the developing unit in FIG. 4.

Next, a configuration of the developing unit 20 described above will be explained in detail. A spin chuck 60 as a rotating device,for holding the wafer W by suction as shown in FIGS. 4 and 5 and rotating it is provided in a center of the developing unit 20. Under the spin chuck 60, provided is a rotating mechanism 61 including, for example, a motor capable of rotating the spin chuck 60, maintaining it at a predetermined rotational speed and changing the rotational speed, and the like.

An almost cylindrical container 62 with its top face being opened is provided to enclose the outer circumference of the spin chuck 60. The container 62 is designed so that a clearance G is formed between an upper end portion of the container 62 and a peripheral portion of an underside of the wafer W when the wafer W is placed on the spin chuck 60. Jet ports 63 for jetting an inert gas or the like are provided in an undersurface of the container 62, and an inert gas is supplied into the container 62 and is discharged from the aforementioned clearance G. Accordingly, at the peripheral portion of the underside of the wafer W, an airflow flowing toward the outside from the container 62 is formed, so that a developing solution on the wafer W is prevented from coming onto the peripheral portion of the underside of the wafer W. Ring members 65 for adjusting a size of the aforementioned clearance G to be suitable are provided at upper portions of side walls of the container 62.

Further, a ring-shaped cup 70 having a double structure, with its top face being opened, is provided to enclose the periphery of the container 62 so as to receive the developing solution and the like dropping due to centrifugal force from the wafer W held on the aforementioned spin chuck 60 by suction and rotated and so as to prevent the units around it from being contaminated. Drainpipes 73 through which the developing solution and the like dropping from the aforesaid wafer W and the like is discharged are provided in a bottom portion of the cup 70.

A developing solution supply nozzle 75 for supplying the developing solution to the wafer W is provided above the spin chuck 60 to be movable horizontally. The developing solution supply nozzle 75 is supported by a vertical support rod 76 and a horizontal support rod 78 extending horizontally through a joint member 77.

The horizontal support rod 78 is connected to a nozzle moving mechanism 79 capable of moving the horizontal support rod 78 in a predetermined direction (the X-direction in FIGS. 4 and 5), which makes the developing solution supply nozzle 75 movable from a nozzle waiting portion 80 located outside one end of the cup 70 to the other end of the cup 70 through the horizontal support rod 78.

The nozzle waiting portion 80 is the place at which the developing solution supply nozzle 75 waits during an interim of the developing treatment for the wafer W, where dummy-dispensing or the like is performed for removing the developing solution adhering to a tip end of the developing solution supply nozzle 75 as necessary.

The developing solution nozzle 75 is formed to have a shape of a rectangular parallelepiped and a length of about the radius of the wafer W, and it is supported by the aforementioned horizontal support rod 78 so as to be longer in the horizontal direction.

Supply pipes 82 through which the developing solution from a developing solution supply source not shown is supplied to the developing solution supply nozzle 75 are each provided at two locations in a top surface of the developing solution supply nozzle 75, and the supply pipe 82 is provided with a temperature adjusting function not shown.

Figure 6:
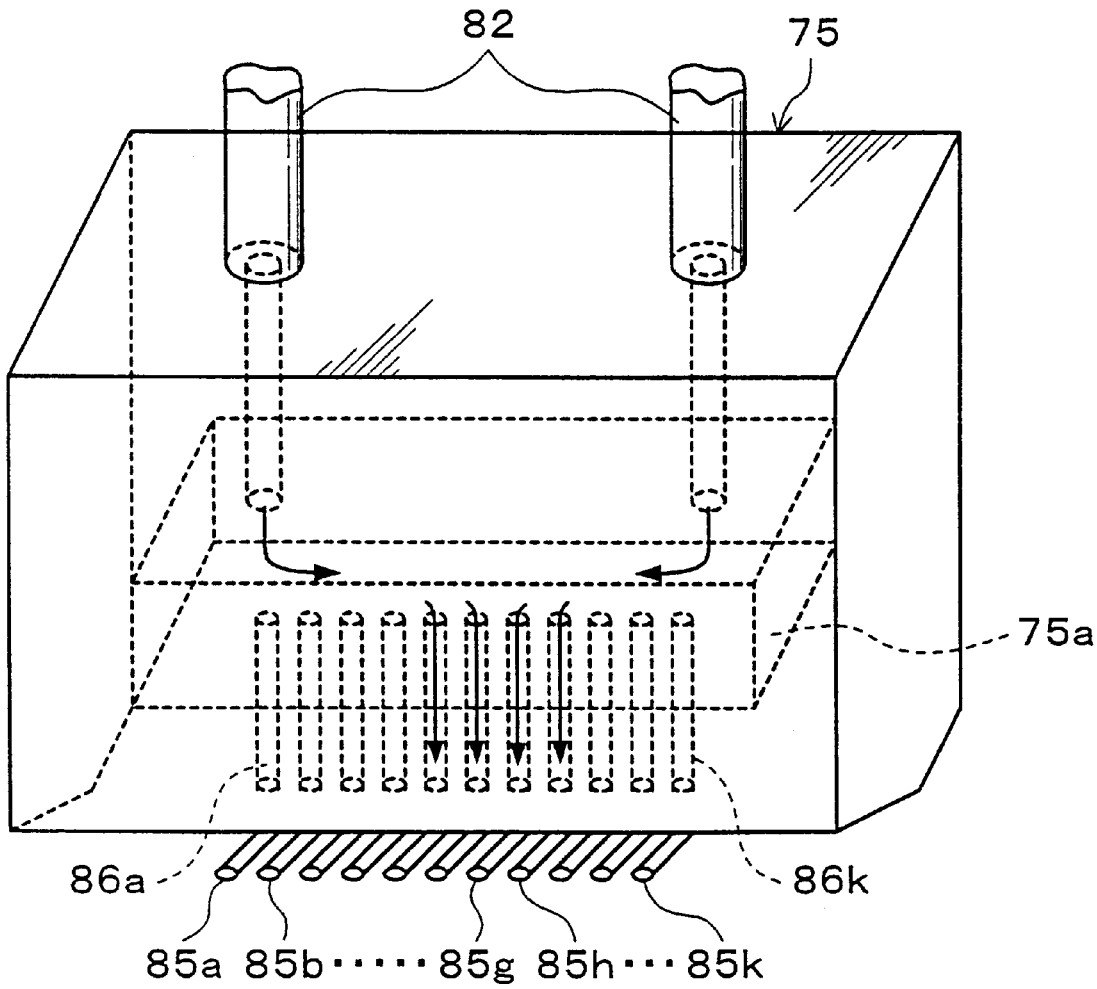
FIG. 6 is a perspective view showing a developing solution supply nozzle used in the developing unit according to the present embodiment.

A storage portion 75*a* being a long thin space longitudinally extending is provided inside the developing solution supply nozzle 75 as shown in FIG. 6, and the developing solution from the aforementioned supply pipes 82 are stored temporarily. Under the storage portion 75*a*, that is, at the lower portion of the developing solution supply nozzle 75, a plurality of, for example, eleven supply ports 85*a* to 85*k* for supplying the developing solution to the wafer W are provided to be equally spaced along the longitudinal direction of the nozzle and face the nozzle waiting portion 80 side. In other words, the supply ports 85*a* to 85*k* are provided to face a direction of the periphery of the wafer W.

These supply ports 85*a* to 85*k* are communicated with the aforementioned storage portion 75*a* by supply paths 86*a* to 86*k* respectively corresponding thereto. Consequently, the developing solution in the storage portion 75*a* is discharged from the supply ports 85*a* to 85*k* through the supply paths 86*a* to 86*k*. The supply ports 85*a* to 85*k* are provided to form a predetermined angle θ, for example, 45 degrees with the vertical downward direction, as shown in FIG. 4, so that the developing solution is simultaneously discharged from each of the supply ports 85*a* to 85*k* in the direction at the predetermined angle θ.

Figure 7:
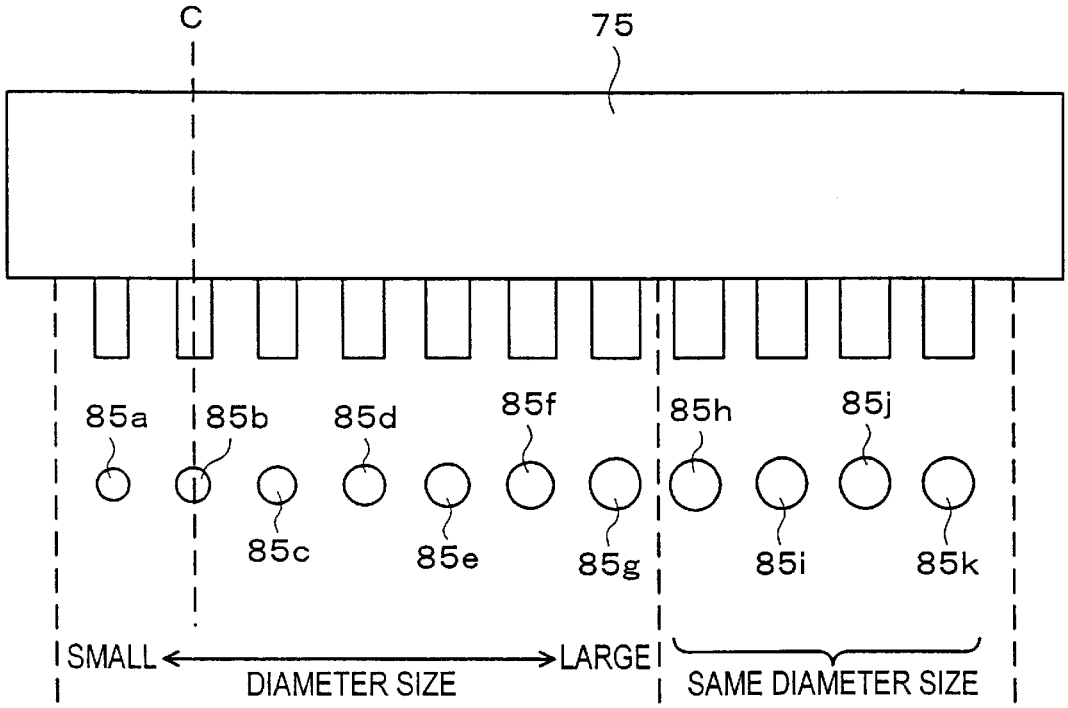
FIG. 7 is an explanatory view showing sizes of diameters of supply ports of the developing solution supply nozzle.

As shown in FIG. 7, as for the sizes of diameters of the aforementioned supply ports 85*a* to 85*k*, the diameters of the supply port 85*a* to the supply port 85*g* are set to be gradually larger, and the sizes of the diameters of the supply port 85*h* to the supply port 85*k* are set to be the same as that of the supply port 85*g*. To be more specific, the diameter of the supply port 85*a* is about 1 mm, and the diameter of the supply port 85*g* is about 2 mm.

The developing solution supply nozzle 75 having the supply ports 85*a* to 85*k* moves above the wafer W in a horizontal direction and in a predetermined direction, and the developing solution supply nozzle 75 is disposed so that the supply port 85*b* passes above the center of the wafer W. Accordingly, the supply ports 85*a* to 85*f* with comparatively small diameters pass above a center portion area of the wafer W, and the supply ports 85*g* to 85*k* with comparatively large diameters passes above the peripheral portion area of the wafer W. As the result, when the developing solution is discharged under the same pressure from each of the supply ports 85*a* to 85*k*, the discharge amount is smaller on the wafer W center portion and becomes smaller at an area nearer to the center.

The solution developing supply nozzle 75 is attached to the horizontal support rod 78 so as to form a predetermined angle ϕ, for example 0° to 30° with respect to the perpendicular direction (the Y-direction in FIG. 5) to the moving direction (the X-direction) of the developing solution supply nozzle 75 as shown in FIG. 5. The distance between a tip end of the support port 85 and the wafer W is adjusted to be a suitable length, for example, about 10 mm, thereby preventing the support porst 85 from being too close to the wafer W and touching the developing solution supplied on the wafer W, or preventing the support ports 85 from being too far therefrom and giving large discharge impact of the developing solution to the wafer W to the contrary.

A cleaning solution support nozzle not shown is provided above the spin chuck 60 aside from the developing solution supply nozzle 75, and a cleaning solution is supplied onto the wafer W from the cleaning solution supply nozzle after developing treatment of the wafer W, thereby making it possible to clean the wafer W.

Next, the operation of the developing unit 20 structured as above will be explained with the process steps of the photolithography process performed in the coating and developing system 1.

Initially, the wafer carrier 7 takes one unprocessed wafer W out of the cassette C, and transfers it to the adhesion unit 31 included in the third processing unit group G3. In the adhesion unit 31, the wafer W is coated with an adhesion reinforcing agent such as an HMDS for enhancing adhesion to the resist solution, and thereafter it is transferred to the cooling unit 30 by the main transfer device 13 and cooled to a predetermined temperature. Thereafter, the wafer W is transferred to the resist coating unit 17 or 19, the prebaking unit 34 or 35 in order, whereby a predetermined treatment is performed. Thereafter, the wafer W is transferred to the extension and cooling unit 41.

Subsequently, the wafer W is taken out of the extension and cooling unit 41 by the wafer carrier 50, and thereafter it is transferred to an aligner (not shown) via a peripheral aligner 51. The wafer W for which exposing processing is finished is transferred to the extension unit 42 by the wafer carrier 50, and thereafter it is held by the main transfer device 13. Subsequently, the wafer W is transferred to the post exposure baking unit 44 or 45, and the cooling unit 43 in order, and after a predetermined treatment is performed in these treatment units, the wafer W is transferred to the developing unit 18 or 20.

The wafer W for which developing treatment is finished is transferred to the postbaking unit 35 and the cooling unit 30 in order by the main transfer device 13. Thereafter, the wafer W is returned to the cassette C by the wafer carrier 7 via the extension unit 32, whereby a series of predetermined coating and developing treatment is finished.

Explaining the operation of the aforementioned developing unit 20 in detail, the wafer W. which is initially cooled to a predetermined temperature in the cooling unit 43, is transferred into the developing unit 20 by the main transfer device 13, and is placed on the spin chuck 60.

Figure 8:
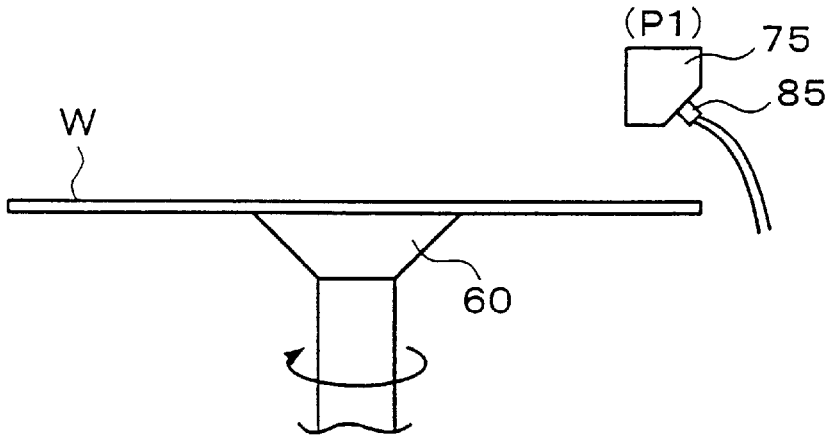
FIG. 8 is a schematic side view showing a state in which the developing solution supply nozzle is at a position of a peripheral portion in a developing treatment process in the developing unit according to the present embodiment.
Figure 9:
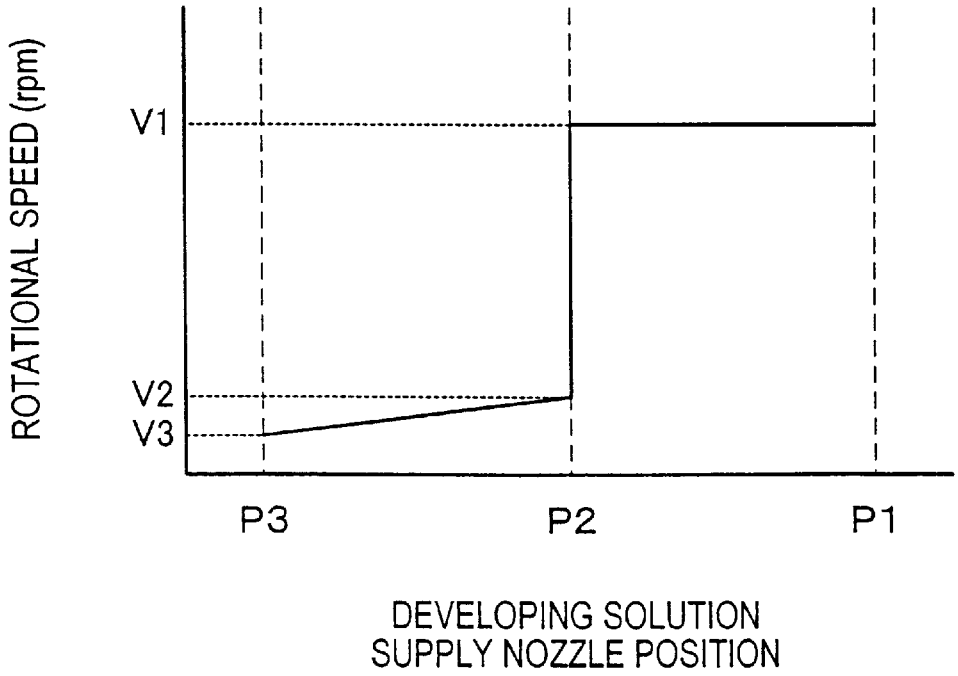
FIG. 9 is a graph showing a transition of a rotational speed of a spin chuck in developing treatment of a wafer.

Subsequently, the developing treatment process for the wafer W is started, and as shown in FIG. 4, the developing solution supply nozzle 75 moves to a position P1 above the peripheral portion of the wafer W from the nozzle waiting portion 80. FIG. 8 shows the position after the nozzle moves. The spin chuck 60 is also started to rotate at this time, and it is maintained at a first speed V1 as a predetermined speed, for example, at 1000 rpm. FIG. 9 shows the transition of the rotational speed of the spin chuck 60 following the movement of the developing solution supply nozzle 75.

Next, the developing solution is discharged at a predetermined flow rate to the cup 70 from the developing solution supply nozzle 75 (FIG. 8). At this time, the temperature-adjusted developing solution flows into the storage portion 75*a* from the supply pipes 82, then it further flows from the 20 storage portion 75*a* to each supply path 86, and is discharged from each of the support ports 85*a* to 85*k* at the same time.

So-called trial discharge as above is performed until the flow rate of the developing solution is stabilized, and after a lapse of a predetermined time, the developing solution supply nozzle 75 is started to move.

Figure 10:
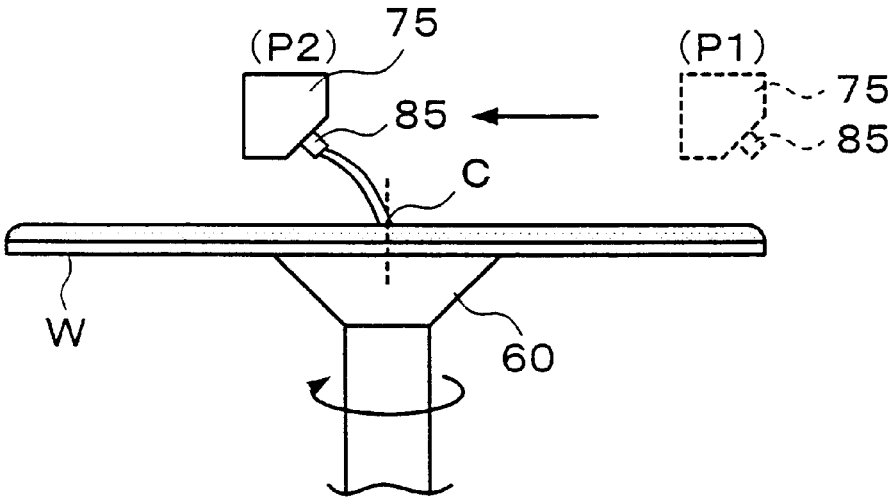
FIG. 10 is a schematic side view showing a state in which the developing solution supply nozzle is at a position near a center portion in the developing treatment process in FIG. 8.

With the rotational speed of the wafer W being maintained at the first speed V1, the developing solution supply nozzle 75 moves from the aforementioned position P1 above the wafer W to a predetermined position P2 above the center portion of the wafer W at a predetermined moving speed, for example, 100 mm/s. Since the wafer W is rotated at a high speed at this time, the developing solution is evenly supplied to the wafer W, and a thin film of the developing solution is swiftly formed, whereby developing treatment for the wafer W is started (FIG. 10). The aforementioned predetermined position P2 is the position at which the developing solution discharged from the supply port 85*b* is supplied to a center C of the wafer W.

In the state in which the solution supply nozzle 75 reaches the predetermined position P2 and is stopped once, the rotational speed of the spin chuck 60 is reduced from the first speed V1 to the second speed V2 as the other predetermined speed, for example, 100 rpm. If the first deceleration rate is too high in this situation, centripetal force becomes too large, whereby the developing solution already supplied on the wafer W is drawn toward the center portion. On the other hand, if it is too low, the total developing time becomes long, and thus it is suitable to decelerate at a suitable deceleration rate, for example, 1000 rpm/s.

Figure 11:
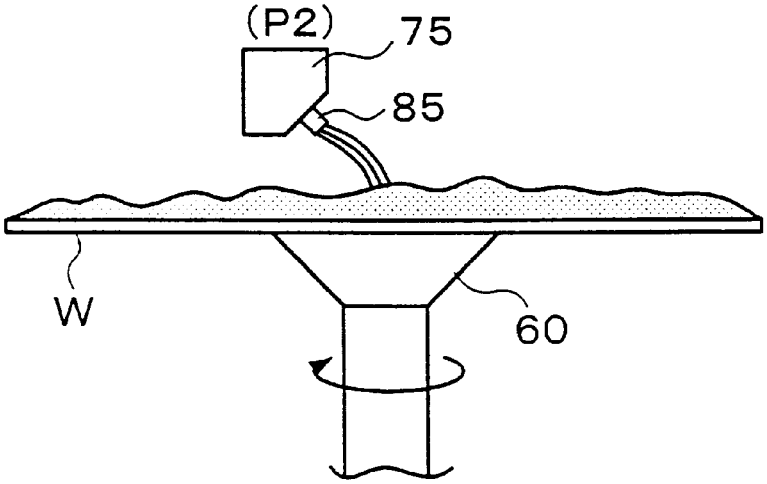
FIG. 11 is a schematic side view showing a state in which the developing solution supply nozzle is at the position near the center portion in the developing treatment process in FIG. 8.
Figure 12:
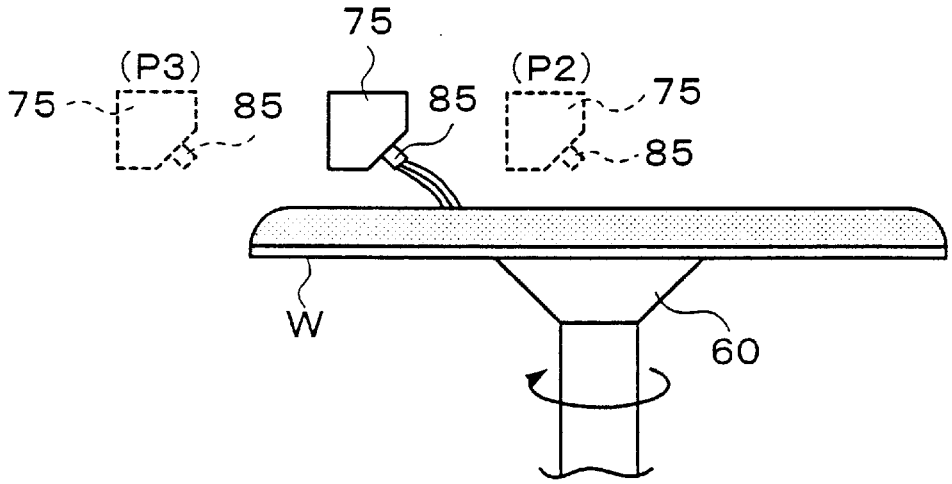
FIG. 12 is a schematic side view showing a state in which the developing solution supply nozzle moves from the position near the center portion to a position of a peripheral portion at the other end portion in the developing treatment process in FIG. 8.

When the developing solution is supplied for a predetermined period of time with the rotational speed being maintained at 100 rpm, thicker film of the developing solution begins to be formed on the wafer W (FIG. 11). Thereafter, the developing solution supply nozzle 75 starts to move again, and moves from the position P2 to a position P3 at the other end of the wafer W (FIG. 12). The moving speed at this time is 50 mm/s, which is lower than the speed at which it moves from the position P1 to the position P2. During the movement, the rotational speed of the wafer W is reduced at a second deceleration rate from the second speed V2 to a third speed V3, for example, 30 rpm.

As a result of the moving speed being reduced, and the rotational speed being reduced as described above, a thick film of a suitable amount of developing solution without unevenness is formed on the wafer W. It is suitable to set the second deceleration rate of the rotational speed at a smaller value than the aforementioned first deceleration rate since the difference from the rotational speed to be obtained by reduction is small and it is necessary to perform solution heaping evenly.

Figure 13:
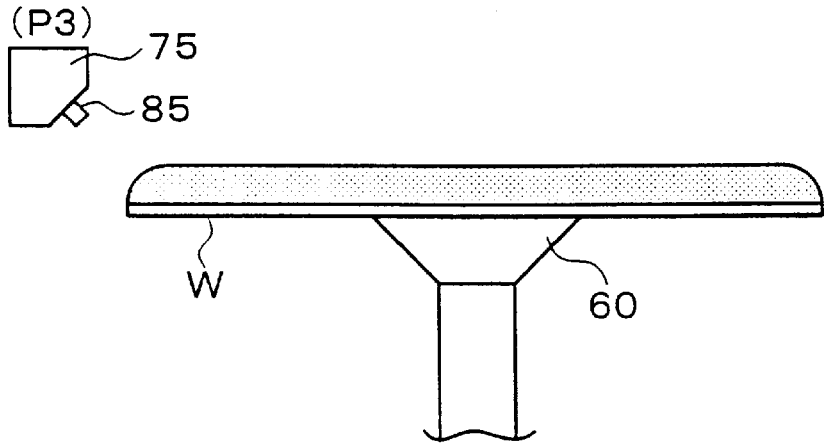
FIG. 13 is a schematic side view showing a state in which the developing solution supply nozzle is at the position of the peripheral portion at the other end portion in the developing treatment process in FIG. 8.

Thereafter, when the developing solution supply nozzle 75 reaches the position P3 outside the other end of the wafer W, the developing solution supply nozzle 75 is stopped, and the supply of the developing solution is stopped (FIG. 13). The rotation of the wafer W is stopped once, and the wafer W is subjected to development for a predetermined period of time in a state in which it is at a standstill.

Thereafter, the developing solution supply nozzle 75 is moved to the nozzle waiting portion 80, while the wafer W is rotated again to be washed and dried.

Figure 14:
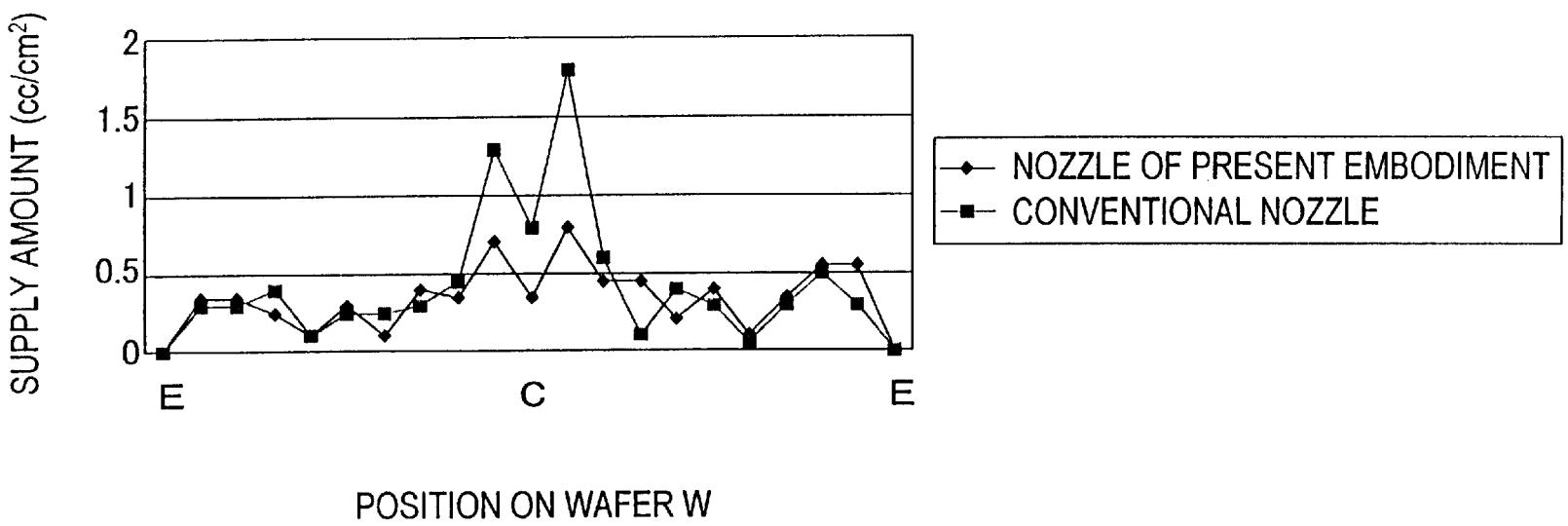
FIG. 14 is a graph showing supply amounts of the developing solution at each position on the wafer when a conventional developing solution supply nozzle and the developing solution supply nozzle of the present embodiment are used.

In the above embodiment, the support ports 85*a* to 85*k* of the developing solution supply nozzle 75 is provided to have smaller sized diameters as they are located at the position nearer the center area of the wafer W, and therefore the total amount of the developing solution supplied to the center area of the wafer W becomes smaller than that to the peripheral portion of the wafer W. As the result, as shown in FIG. 14, variations in the supply amount per area in the center area of the wafer W is reduced as compared with an prior art, and the developing solution is uniformly supplied within the wafer W surface. Consequently, evenness of line width finally formed on the wafer W is improved. and the yield is enhanced.

Further, since the rotational speed of the wafer W is maintained at the first speed V1 while the developing solution supply nozzle 75 is moving from the position P1 to P2. the developing solution is evenly supplied onto the wafer W quickly, and development can be started with minimum time difference. As long as the aforementioned effect can be obtained, the first speed V1 may be changed.

Furthermore, since the rotational speed of the wafer W is reduced from the first speed V1 to the second speed V2 at the position P2, full-scale supply of the developing solution is started at the position P2. Thereafter, the developing solution supply nozzle moves from the position P2 to P3, thereby decreasing the supply amount of the developing solution to the center of the wafer W, and by reducing the rotational speed to the third speed V3, larger amount of developing solution can be heaped on the wafer W with less unevenness.

In the above embodiment, the diameter of the supply port 85 of the developing solution supply nozzle 75 is made gradually larger from the supply port 85 a to the supply port 85*g*, and the supply port 85*g* to supply port 85*k* have the diameters of the same size, but the diameters of the supply port 85*a* to the supply port 85*k* may be designed to be gradually larger. This is because in the peripheral portion of the wafer W, more developing solution also has to be supplied at a portion nearer to the outer edge portion in order to form even solution heaping of the developing solution on the wafer W. Thus, by changing the diameters, a more even film of the developing solution is also formed on the peripheral portion of the wafer W.

Further, it may be suitable to check the thickness of solution heaping of the developing solution finally formed on the wafer W, and when the supply ports 85 are designed, the size of the diameter of each supply port 85 may be determined based on the check results. Specifically, it may be suitable that only the diameter of the supply port at a predetermined position is larger and a plurality of supply ports having the other kind of diameters are arranged at the positions based on the aforementioned check.

Figure 15:
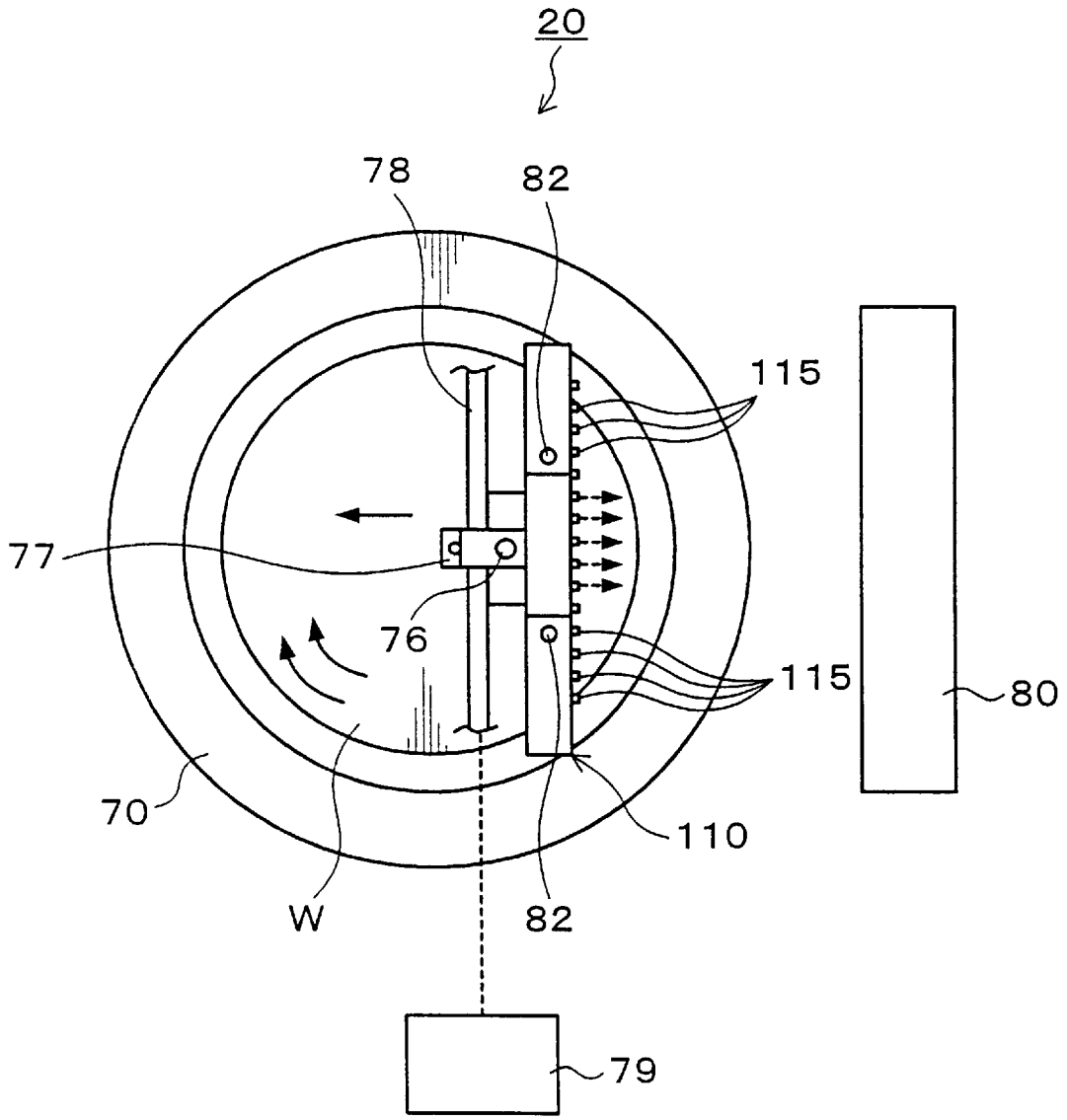
FIG. 15 is an explanatory view showing a developing unit in plane when a developing solution nozzle of another embodiment is used.
Figure 16:
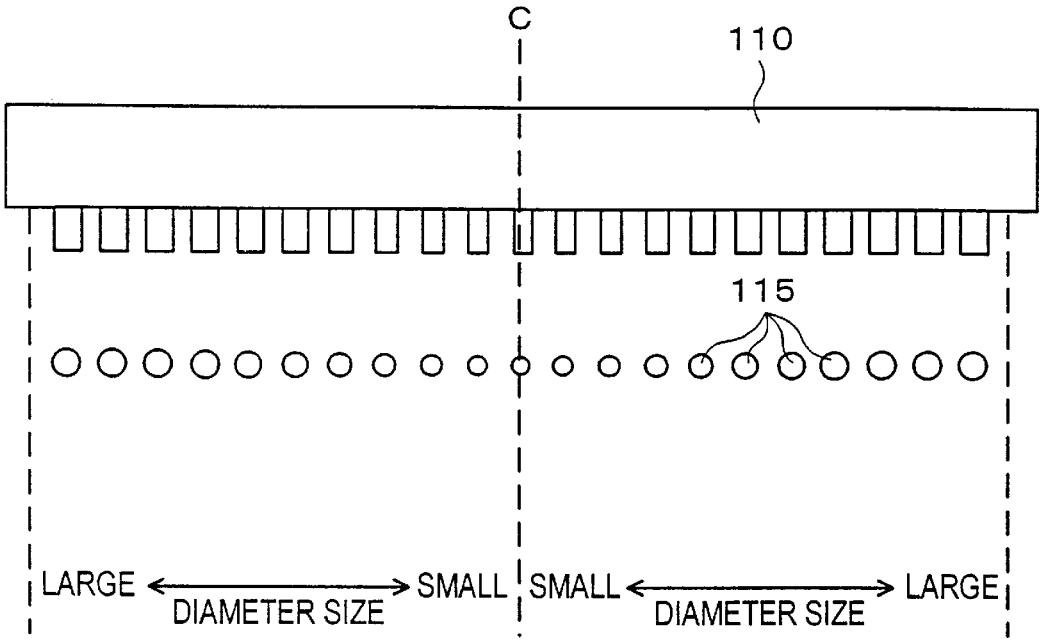
FIG. 16 is an explanatory view showing sizes of diameters of supply ports of the developing solution supply nozzle in FIG. 15.

In the above embodiment, developing treatment is performed with use of the predetermined developing solution supply nozzle 75, but it may be suitable to use a developing solution supply nozzle in the other shape, for example, a developing solution supply nozzle 110 having the length of the diameter of the wafer W, with the diameters of supply ports 115 closer to the center of the wafer W being made smaller, as shown in FIGS. 15 and 16. In such a case, the amount of developing solution supplied to the center portion of the wafer W is also reduced, and thus the amount of the developing solution becomes even on the entire surface of the wafer W.

The embodiment explained thus far is related to the developing unit for the wafer W in the photolithography process in the semiconductor wafer device fabrication process, but the present invention is also applicable in a developing unit for a substrate other than the semiconductor wafers, for example, an LCD substrate.

According to the present invention, since the amount of the developing solution supplied onto the substrate by the developing solution supply nozzle becomes even within the substrate surface, developing treatment in the substrate surface is evenly performed, and as the result, a line width finally formed becomes even, thus enhancing yield. The diameters of the supply ports are changed, and the supply ports are provided so that the amount of the developing solution supplied to the center of the substrate is decreased, thereby controlling variations in the supply amount to the center area of the substrate, which is conventionally feared.

Further, the developing solution is supplied while the developing solution supply nozzle is moved from the center portion of the substrate to the other end portion of the substrate, thereby decreasing the amount of the developing solution supplied to the center area of the substrate and making it possible to improve evenness of the developing solution within the surface of the substrate.

What is claimed is:

1. A developing unit for developing a substrate, comprising:

a rotating device configured to hold and rotate the substrate; and a developing solution supply nozzle having a length substantially equal to a radius of the substrate and including a plurality of supply ports aligned in a row to dispense the developing solution to the substrate at a predetermined angle, the developing solution supply nozzle being configured to move horizontally over and at least across the substrate in a predetermined direction;

wherein said plurality of supply ports become gradually smaller toward a center portion of the substrate.

2. A developing unit for developing a substrate, comprising:

a rotating device configured to hold and rotate the substrate; and a developing solution supply nozzle having a length substantially equal to a radius of the substrate and including a plurality of supply ports aligned in a row to dispense the developing solution to the substrate at a predetermined angle, the developing solution supply nozzle being configured to move horizontally over and at least across the substrate in a predetermined direction;

wherein:

the developing solution supply nozzle is positioned such that one end portion of the developing solution supply nozzle passes over a center portion of the substrate; and the plurality of supply ports becomes gradually larger from the one end portion toward an opposite end portion.

3. A developing unit for developing a substrate, comprising:

a rotating device configured to hold and rotate the substrate; and a developing solution supply nozzle having a length substantially equal to a radius of the substrate and including a plurality of supply ports aligned in a row to dispense the developing solution to the substrate at a predetermined angle, the developing solution supply nozzle being configured to move horizontally over and at least across the substrate in a predetermined direction;

wherein:

the developing solution supply nozzle is positioned such that one end portion of the developing solution supply nozzle passes over a center portion of the substrate; and the plurality of supply ports becomes gradually larger from the one end portion toward an opposite end portion and equal in size in the opposite end portion.

4. A method for developing a substrate, comprising the steps of:

providing a developing solution supply nozzle having a length substantially equal to a radius of the substrate;

moving the developing solution supply nozzle horizontally over and across the substrate in a predetermined direction while the substrate is rotating; and supplying a developing solution to the substrate from the developing solution supply nozzle during the moving step;

wherein the moving step comprises stopping the developing solution supply nozzle once above a center portion of the substrate, decreasing a rotational speed of the substrate down to a predetermined speed when the developing solution supply nozzle is stopped above the center portion of the substrate, and decreasing the rotational speed of the substrate from the predetermined speed at a predetermined deceleration rate when the developing solution supply nozzle moves from the center portion to a finishing end portion of the substrate.

5. The developing method according to claim 4, wherein the rotational speed of the substrate is decreased while the developing solution supply nozzle is moving from a starting end portion of the substrate to the center portion.

6. A method for developing a substrate, comprising the steps of:

providing a developing solution supply nozzle having a length substantially equal to a radius of the substrate;

moving the developing solution supply nozzle horizontally over and across the substrate in a predetermined direction while the substrate is rotating; and supplying a developing solution to the substrate from the developing solution supply nozzle during the moving step;

wherein the moving step comprises stopping the developing solution supply nozzle once above a center portion of the substrate, decreasing a rotational speed of the substrate down to a predetermined speed at a first deceleration rate while the developing solution supply nozzle is stopped above the center portion of the substrate, and decreasing the rotational speed of the substrate from the predetermined speed at a second deceleration rate while the developing solution supply nozzle is moving from the center portion to a finishing end portion of the substrate, the first deceleration rate being lager than the second deceleration rate.

7. The developing method according to claim 6, wherein the rotational speed of the substrate is decreased while the developing solution supply nozzle is moving from a starting end portion of the substrate to the center portion.

* * * * *